US008042702B2

(12) United States Patent
Stevenson

(10) Patent No.: US 8,042,702 B2
(45) Date of Patent: Oct. 25, 2011

(54) RECONFIGURABLE CONTAINER AND METHODS OF FABRICATION AND USE THEREOF

(75) Inventor: Robin Stevenson, Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 535 days.

(21) Appl. No.: 11/758,030

(22) Filed: Jun. 5, 2007

(65) Prior Publication Data

US 2008/0302789 A1 Dec. 11, 2008

(51) Int. Cl.
*B65D 6/00* (2006.01)

(52) U.S. Cl. ..... 220/6; 220/4.28; 220/4.33; 220/639; 220/666; 220/780; 264/101; 428/12; 428/76

(58) Field of Classification Search ..... 220/6, 666, 220/780, 4.28, 4.33, 639; 264/101; 428/12, 428/76

See application file for complete search history.

(56) References Cited

U.S. PATENT DOCUMENTS

| | | | | |
|---|---|---|---|---|
| 7,530,466 | B2 * | 5/2009 | Spinelli et al. | 220/201 |
| 2002/0043736 | A1 * | 4/2002 | Murakami et al. | 264/45.1 |
| 2003/0160055 | A1 * | 8/2003 | Stewart-Stand | 220/666 |

* cited by examiner

*Primary Examiner* — Anthony Stashick
*Assistant Examiner* — Elizabeth Volz
(74) *Attorney, Agent, or Firm* — Quinn Law Group, PLLC

(57) ABSTRACT

Reconfigurable containers which may adopt two stable configurations are described. In the first configuration, the container is suitable for the storing and transport of goods. When in a second, collapsed configuration, the container occupies a lesser volume than the first configuration and thus requires less shipping space. This is accomplished through the use of at least one deformable active material member that is preferably a shape memory polymer and, optionally, releasable fasteners.

10 Claims, 5 Drawing Sheets

RECONFIGURABLE CONTAINER AND METHODS OF FABRICATION AND USE THEREOF

TECHNICAL FIELD

The invention relates to a reconfigurable container, a method of fabricating such a container, and a method of use of such a container.

BACKGROUND OF THE INVENTION

Shipping containers are used extensively in transporting a broad range of goods ranging from manufactured articles to fresh produce, and typically serve to protect the articles from shipping damage as well as facilitate their handling.

To perform its primary role of protecting the goods contained within it, it is important that the container be strong enough to withstand any loads which may be encountered in shipping. In some cases, the nature of the goods being transported and/or their mode of transportation may permit the use of relatively light containers fabricated of low-cost materials, which may be discarded or recycled after delivery. However, where heavier, more robust shipping containers are required, simply discarding the container after only one use may not be economically viable. In these cases, returning the containers to their point of origin for re-use is frequently a more attractive option.

However, containers are bulky items and most transportation modes employed in shipping goods are volume-constrained rather than mass-constrained. Thus, the number of empty containers which can be accommodated in a vehicle such as a truck, railcar or airplane is no greater than the number of loaded containers which can be accommodated in a like vehicle despite the significantly lower weight of the empty containers. This may impose a significant transportation cost burden on re-use of shipping containers.

One approach to addressing this issue has been to design containers whose geometry is capable of reversible modification so that it may be compacted to occupy a significantly smaller volume when empty while retaining the ability to be reconfigured to its original, full volume when required.

One design for reconfigurable shipping containers introduces fold lines into the container along which the container material may be folded and unfolded to achieve reconfiguration. This approach however limits the range of materials from which the container may be constructed to those which are capable of reversibly folding and unfolding without sustaining or accumulating damage to the material, which would limit its life. In addition, the fold locations must be weaker than the unfolded container locations to force folding to occur in only those desired fold locations.

SUMMARY OF THE INVENTION

A reconfigurable container is provided that has a plurality of deformable active material members adapted to be deformed when activated such that the container is reconfigurable between a first configuration and a second configuration. One of the configurations defines a storage space, suitable for filling with goods to be shipped, and the other configuration is a collapsed configuration that is more compact than the first configuration. Activation may be by various activation means known to activate active materials, such as thermal activation by resistive heating, ambient heating, convection, radiation, moisture activation, etc.

The deformable active material members do not limit the other materials from which the container may be constructed and in which the shape of the deformable active material members may be reversed without significantly prejudicing the container's ability to undergo future reconfigurations. The ability of an active material, and in particular a shape memory polymer, to adopt both a pliant, reshapeable state at an elevated, reconfiguration temperature and a stiffer, shape-maintaining state under differing activation conditions (which may be passive environmental conditions or controlled excitation) addresses the dual requirements of reconfigurability and durability required for shipping and storage containers.

Shape memory materials are able to store a deformed (temporary) shape and recover an original (parent) shape, typically as a result of a change in temperature. Possibly the most familiar materials which exhibit this behavior are the metallic alloy Shape Memory Alloys (SMAs) of which Nitinol (an equi-atomic alloy of Nickel and Titanium) is a well-known example. SMAs exist in two states: a high temperature, high strength austenite phase and a low temperature, low strength martensite phase. A shape memory effect is observed when the temperature of a shape memory alloy sample is cooled to below a temperature at which the alloy is completely composed of martensite, the lower strength, and thus readily-deformable phase, and then deformed to a desired shape. The SMA sample retains the deformed shape while in the martensite phase but the original shape can be recovered simply by heating the sample above the temperature at which austenite reforms. This transforms the deformed martensite into the austenite phase, which is configured in the original shape of the SMA sample. The temperatures at which these phase changes occur may be manipulated either by deviating from a precisely equi-atomic composition or through the addition of minor quantities of another alloying element such as copper, iron or chromium. The transformation temperature may be varied between at least −100° C. to +100° C.

Shape memory polymers or plastics (SMPs), a polymer-based family of active or "smart" materials, may be deformed at relatively low stresses and demonstrate large recoverable strains—as much as 200% in some cases. SMPs cannot be defined by chemistry or polymer category and can be either a thermoset or thermoplastic. Shape memory materials such as SMPs are able to store a deformed (temporary) shape and recover an original (parent) shape, typically as a result of a change in temperature.

A key characteristic of an SMP is that it possesses a chemically or physically cross-linked network structure, which permits a rubbery plateau at a temperature above either the glass transition temperature, $T_g$, or the crystallization temperature, $T_c$. Additionally $T_g$ and $T_c$ can be tailored or modified by the control of the polymer's chemistry and structure resulting in the ability to use a wide range of polymer classes and blends to tailor the SMP characteristics to a desired application. As used herein, the term glass transition temperature, $T_g$ will be understood to also include the crystallization temperature, $T_c$ for those polymer systems that exhibit a crystallization temperature.

SMPs exhibit a sharp transition in properties over a narrow (10-20 degrees Celsius) temperature range about $T_g$. Specifically the extent to which an SMP will deflect under load changes dramatically when the glass transition temperature is exceeded. The extent of the change may be readily appreciated by comparing the modulus of a particular thermoset SMP epoxy system below $T_g$, where its modulus is approximately 886 MPa, to its mechanical response above $T_g$ where its modulus is approximately 8.5 MPa. Corresponding to this sharp transition in properties is a corresponding change in behavior from a rigid polymer to a rubber-like elastic state. If an external load is applied to the polymer in this elastic state, reversible, quasi-elastic deformation occurs. In turn, this leads to the accumulation of stored energy within the polymer that, upon removal of the external load drives the polymer to adopt its original shape, provided the temperature is maintained above $T_g$. If, alternatively, the temperature is reduced below $T_g$, before the load is removed, the deformed shape will be 'frozen' into the polymer and retained indefinitely, but the original shape may always be recovered by heating the polymer above $T_g$ in the absence of applied stress, where the stored energy will act to deform the SMP in its low-modulus configuration.

This combination of properties and their manipulation by control of temperature lends itself to an on-demand change in shape of any component fabricated of SMP by following the following process: heat the component above $T_g$; deform the component to a new shape in its quasi-elastic state; reduce the temperature below $T_g$ to retain the deformed shape and heat above $T_g$ in the absence of applied stress to recover the original shape. Note that once below its $T_g$, i.e., in its high modulus state, the SMP will maintain this new shape, even when larger loads are imposed on it, by virtue of its higher stiffness below $T_g$ and thus in its high modulus state the SMP may be applied in structural applications.

Further, SMPs have demonstrated this ability to transition from a pliant to a quasi-rigid state with change in temperature, repeatedly, with no obvious change in behavior or material degradation. SMPs may thus be suitably employed as temperature-programmable deformable members in applications where repeated changes in geometry are desired.

Ideally, the $T_g$ of the SMP employed as a deformable active material member in a reconfigurable container lies comfortably above the highest temperature anticipated when the container is in service, i.e., loaded, with goods which are being transported, making due allowance for the fact that the property change occurs over a temperature range and not at a single temperature. For many container applications, an SMP with a $T_g$ of approximately 80 degrees Celsius will be satisfactory since it will be capable of performing satisfactorily at operating temperatures of 50-70 degrees Celsius (140-158 degrees Fahrenheit). Thus, a glass transition temperature not less than 50 degrees Celsius and not greater than 80 degrees Celsius may be ideal. The application of an SMP with a $T_g$ of 100 degrees Celsius or less is desirable since it enables the SMP to change state in hot water or steam, thereby enabling the change in configuration from the deployed configuration to the collapsed configuration to be accomplished in conjunction with a cleaning operation. Ideally, the cleaning operation would be performed even in the absence of the heating requirement, so that the heating requirement is not an additional process step.

Any non-SMP materials used in the reconfigurable containers described herein are capable of sustaining the maximum use temperature of the container without loss of function and are presumed to be stiff, quasi-rigid elements which may be made of any suitable material including metals, alloys, temperature resistant polymers and papers, as well as any composite fabricated using any one or combination of the above.

In some embodiments, the deformable active material members are arranged in orthogonal relationship to one another. Preferably, generally rigid containment members are interconnected to one another via the deformable active material members. The deformable active material members may be secured to the containment members by adhesives, mechanical fasteners, or a variety of other mechanisms, including mechanical interference of the containment members and the deformable active material members. Generally, the containment members are fabricated of cardboard, a polymer, metal or any combination of the above. The containment members may be elongated reinforcement members, spaced from one another with the deformable active material members therebetween. Alternatively, the containment members may form sidewalls, a base, cover flaps and/or a rim of the container. The layout of the containment members and the deformable active material members may enhance the collapsibility of the container, and may enable folding or bending to occur along the deformable active material members. A mechanically weakened area, such as a partial channel or groove in one or more of the containment members, may be used to predetermine the deformation, e.g., folding) of the containment members to the collapsed configuration. A variety of releasable fasteners may be used to secure some of the edges of the containment members to one another (i.e., edges not already secured by deformable active material members).

A method of using the reconfigurable container includes heating the container above the predetermined temperature so that a decrease in modulus of elasticity of the deformable active material members is realized. The predetermined temperature must be less than the glass transition temperature, the combustion temperature, the decomposition temperature and the melting temperature of the containment members. The predetermined temperature is the glass transition temperature of the deformable active material members if the deformable active material members are a shape memory polymer. A force is then applied to deform the deformable active material members from a first shape (which is preferably free from internal stresses) to a second shape, thereby causing the container to adopt a temporary configuration, which is retained by cooling the container below the predetermined temperature. If releasable fasteners are used to connect any of the containment members to one another, these are fastened prior to cooling the container. The temporary configuration is preferably a deployed configuration defining a storage space, so that the container is suitable for use as a shipping container. Optionally, at this point, the container may be filled with goods, transported to a first location, and the goods then unloaded. Any releasable fasteners used are then unfastened, and the container is then reheated to a temperature above the predetermined temperature so that internal stresses caused by the deformation are relieved and the shape memory effect causes the deformable active material members to return to their first, original shape, which is preferably a more compact shape that will minimize cargo space taken up by the empty containers if they are subsequently transported to a second location.

An existing container may be modified to fabricate a reconfigurable container within the scope of the invention. The method of fabrication requires deconstructing the preexisting container into generally planar containment members, e.g., by separating the base and each of the sidewalls of a container from one another. At least one deformable active material member is then attached to two of the adjacent containment members to thereby secure the containment members to one another. Any releasable fasteners used to secure containment members to one another are installed by affixing a first attachment mechanism to one edge of a containment member and then affixing a second attachment mechanism to another edge of another containment member. The two attachment mechanisms form a releasable fastener so that the edges may be releasably fastened to one another.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
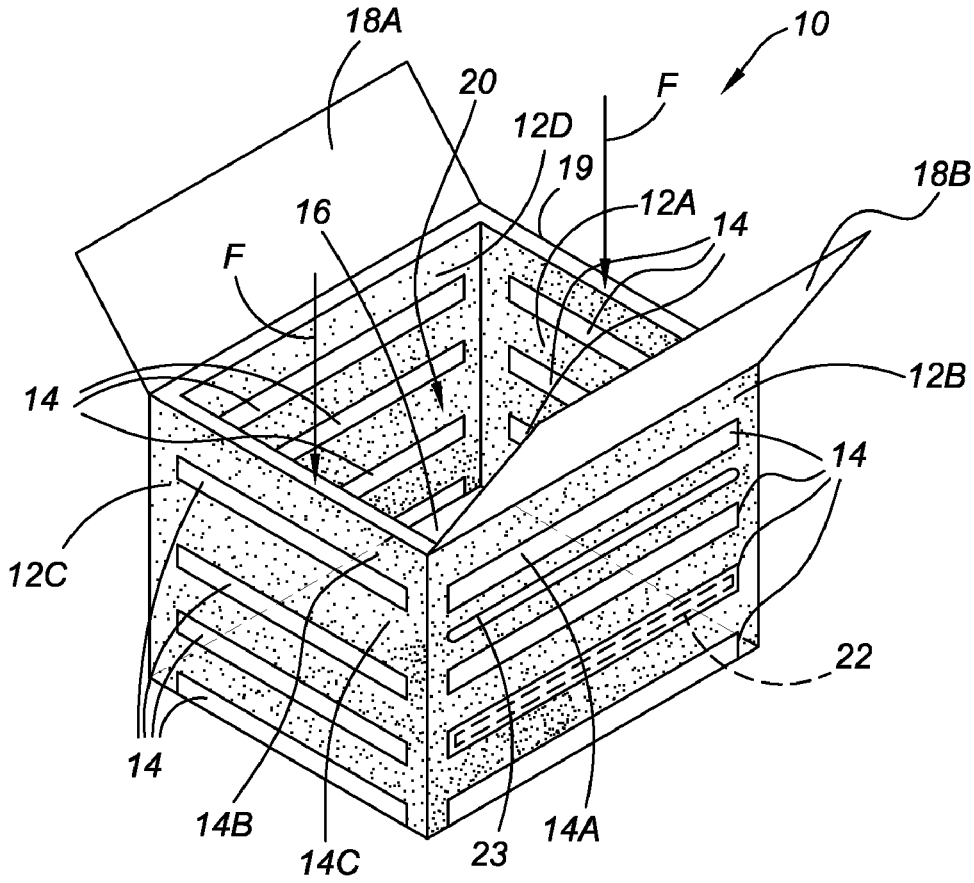
FIG. 1 is a schematic perspective illustration of a first embodiment of a reconfigurable container having a first, deployed configuration.

Referring to the drawings, wherein like reference numbers refer to like components, FIG. 1 shows a first embodiment of a reconfigurable container 10, incorporating SMP deformable members 12A, 12B, 12C and 12D (also referred to herein as deformable active material members), largely forming sidewalls of the container 10, and which may be referred to herein as sidewalls, in an internally stress-free state. Portions of the deformable members 12A-12D are separated by rigid, non-SMP containment members which, in this embodiment, are elongated reinforcement members 14 spaced from one another on each of the deformable members 12A-12D, and here shown as offset from one another on abutting sidewalls (e.g. reinforcement member 14A is at a vertical elevation on the container 10 between that of the reinforcement members 14B and 14C). It should be appreciated that the non-SMP reinforcement members are optional and that, within the scope of the invention, the entire reconfigurable container 10 may be of a deformable active material such as SMP) material. The reinforcement members 14 are non-continuous in the embodiment of FIG. 1, but could alternatively be continuous members (not shown) traversing all four of the sidewalls 12A-12D to partially define a perimeter of the container 10.

Reconfigurable container 10 has other substantially rigid containment members, including a base or lower container closure 16, which attaches to the lower edges of sidewalls 12A-12D and upper container closures or cover flaps 18A, 18B, which may comprise two individual closures as shown, each hingeably attached to any two of the upper edges of facing sidewalls (here sidewalls 12B and 12D) or a single closure hingeably attached to any of the upper edges of sidewalls 12A-12D. Additionally, a reinforcing rim 19 spans all four sidewalls 12A-12D, providing structural support and partially defining a storage space 20 in the container 12. The storage space 20 is further defined by the sidewalls 12A-12D and the base 16. Base 16, upper container closures 18A-18B, and steel rim 19 need not, and preferably would not, be fabricated of SMP material.

As shown, the reinforcement members 14 are elongated strips placed within openings in the sidewalls 12A-12D, where portions of the SMP material forming the sidewalls 12A-12D have been removed prior to attachment of the rigid, non-SMP reinforcement members 14. An exemplary opening 22 where a section has been removed is shown. A similar section is removed at each of the other reinforcement members 14. Alternatively, the sidewalls 12A-12D may be a continuous shell of SMP material (i.e., a continuous deformable active material component) shaped to form a rectangular tube, and the rigid, non-SMP reinforcement members 14 may be attached to surfaces (inner and/or outer surfaces) of the sidewalls 12A-12D. The sidewall 12B may have a groove 23 formed or machined therein that acts as a mechanically weakened area so that the side wall 12B will have a tendency to fold at the groove 23 when collapsing to the configuration of FIG. 2. Preferably, a number of other grooves, not shown, are placed at predetermined locations about the container 10 to encourage a particularly desirable collapse mode.

The reinforcement members 14 may be attached to the underlying SMP material of the sidewalls 12A-12D by any convenient and suitable means including adhesives, welding, mechanical fastening means e.g. rivets, screws, bolts, or by any other means of achieving a permanent attachment of the reinforcement members 14 to the sidewalls 12A-12D.

Figure 2:
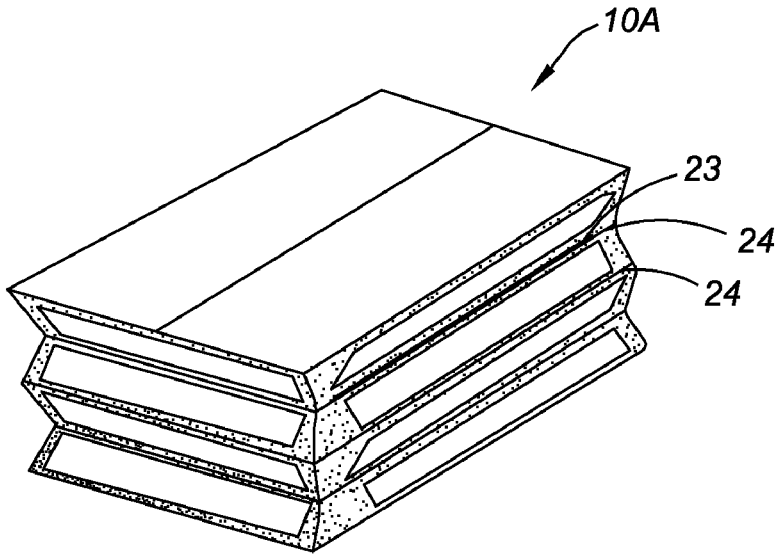
FIG. 2 is a schematic perspective illustration of the reconfigurable container of FIG. 1 having a second, collapsed configuration.

Referring to FIG. 2, the container 10 is shown in a collapsed configuration, in which the container is referred to as 10A. The collapsed configuration of FIG. 2 is more compact than the deployed configuration of FIG. 1 as the SMP material of the sidewalls 12A-12D has been deformed from an overall box-like shape to a concertinaed, folded or bent shape in FIG. 2. The sidewalls form folds or bends 24, with the reinforcement members 14 not visible between the folds. The offset placement of the reinforcement members on adjacent sidewalls, as discussed above, helps enable the neat folds 24 and the more compact configuration of the container 10A.

Reconfiguration of the container 10 from the deployed configuration of FIG. 1 to the collapsed configuration of FIG. 2 is accomplished by first heating the fully deployed container 10 shown in FIG. 1 to a temperature greater than the glass transition temperature $T_g$ of the SMP deformable active material members (sidewalls 12A-12D) and allowing adequate time for all of the SMP material to achieve a temperature greater than $T_g$. Next, a compressive force (as shown by arrows F in FIG. 1) is applied in a substantially downward direction, thereby causing the SMP sidewalls 12A-12D to buckle and collapse in concertina fashion. The force is of a sufficient magnitude and duration to fully collapse the container 10 to the maximum extent possible such that the collapsed sidewall height is reduced to substantially the height of the overlapping reinforcement members 14 when stacked directly on top of one another, with the SMP sidewalls 12A-12D buckled therebetween as represented by the container in collapsed configuration 10A in FIG. 2. When the collapsed configuration is reached, the temperature is reduced below $T_g$ for a sufficient duration to enable the (collapsed) sidewalls to achieve the reduced temperature. Reconfiguration of the container to the deployed configuration 10 of FIG. 1 may occur by raising the temperature of the container above $T_g$ and holding the temperature at this level for a sufficient period of time to enable the stored energy in the (collapsed) SMP sidewalls 12A-12D to relax and automatically (without external force being applied) return to their original "remembered" generally planar shape of FIG. 1 and thereby return the container to its original configuration 10 of FIG. 1. The reinforcing members 14 are shown in FIGS. 1 and 2 as located at essentially equivalent spacing from the base 16 on each of sidewalls 12A-12D. However, if reinforcing members 14 are not continuous, i.e. do not comprise a single reinforcing hoop which attaches to all sidewalls 12A-12D, but instead comprises a series of discrete essentially planar reinforcements attached to only one of sidewalls 12A-12D, it is only necessary that the placement of the reinforcing members 14 relative to base 16 be equal on opposing sidewalls 12A and 12C, and 12B and 12D, and may be vertically displaced relative to one another on abutting sidewalls 12A and 12B, 12B and 12C, 12C and 12D, and 12D and 12A without loss of function. Although in the embodiment of FIGS. 1 and 2 the container 10 is in its relaxed shape (i.e., the shape the container adopts when under no external load and at a temperature greater than $T_g$) in the deployed configuration and in its deformed, internally-stressed shape (temporary shape), in the collapsed configuration, it will be appreciated by those skilled in the art that the relaxed shape could equally well correspond with the collapsed configuration and the deformed, internally-stressed shape correspond with the deployed configuration. (Note that the cover flaps 18A and 18B are shown open in FIG. 1 and closed in FIG. 2. This movement of the cover flaps 18A and 18B is by separate manual force, not due deformation of the SMP material of sidewalls 12A-12D or their recovery to their original configuration upon reheating.)

Figure 3:
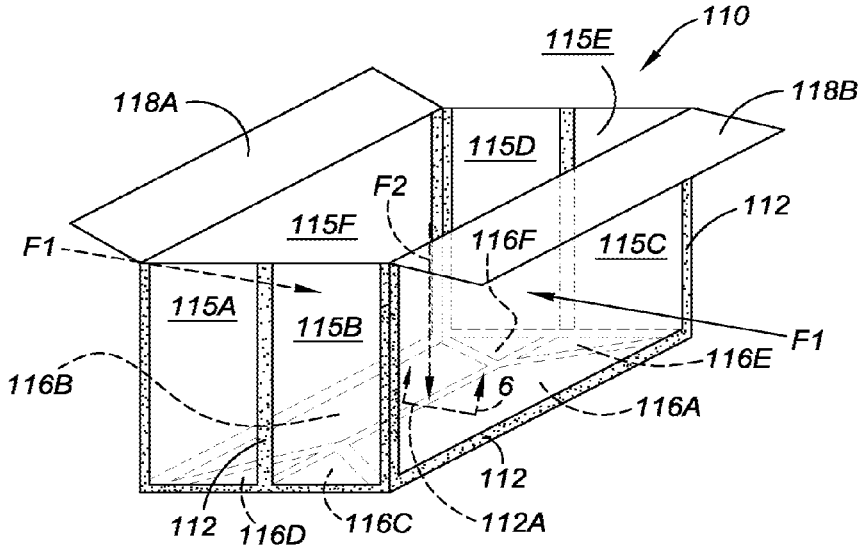
FIG. 3 is a schematic perspective illustration of a second embodiment of a reconfigurable shipping container, including optional cover flaps, having a first, deployed configuration.

FIG. 3 is an alternate embodiment of a container 110 in which deformable active material members 112 of SMP material are linear in character and are disposed only in those locations where folding or bending will occur, with all other parts of the container 110 being comprised of non-SMP rigid, planar containment members such as: sidewalls 115A, 115B, 115C, 115D, 115E, 115F; upper container closures 118A and 118B hingeably attached to the upper surfaces of sidewalls 115C and 115F; and a lower closure comprising six individual elements 116A, 116B, 116C, 116D, 116E, and 116F. The SMP deformable active material members 112 are fabricated to be free of residual stress when the container is in its deployed configuration 110 of FIG. 3 and to function as previously described. These linear SMP deformable active material members 112 are affixed to the non-SMP rigid containment members 115A-115F, 115A-118B, and 116A-116F by any means appropriate to ensure that they do not detach during container usage. Suitable means, without limitation, include mechanical fasteners such as rivets, bolts or screws, adhesives, welding or mechanical interference.

Figure 5:
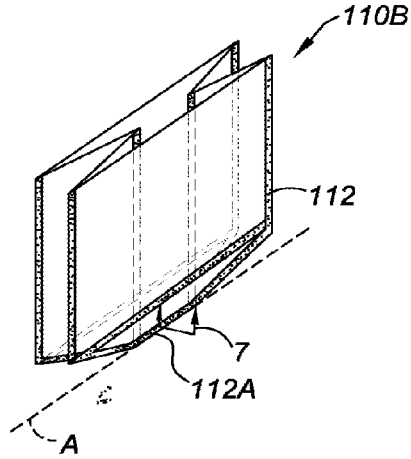
FIG. 5 is a schematic perspective illustration of the shipping container of FIGS. 3 and 4 having a collapsed configuration, with the cover flaps of FIG. 3 not shown for clarity.
Figure 6A:
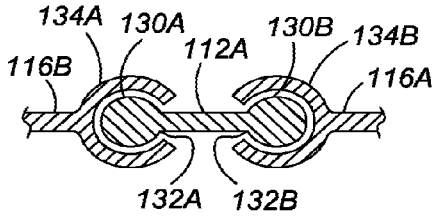
FIG. 6A is a schematic cross-sectional illustration of containment members of the container of FIGS. 3-5 secured to one another by mechanical interference with a deformable active material member, with the deformable active material member in a first, unactivated shape.
Figure 6B:
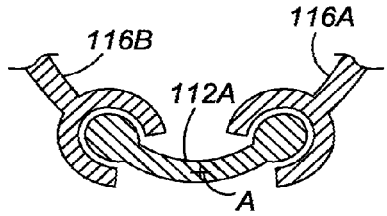
FIG. 6B is a schematic cross-sectional illustration of the containment members of FIG. 6A, with the deformable active material member in a second, activated shape.

FIGS. 6A and 6B show one mechanism for securing adjacent containment members 116A and 116B to SMP deformable active material member 112A. SMP deformable active material member 112A incorporates a feature 130A, 130B on either edge 132A, 132B thereof capable of insertion into a complementary edge feature 134A, 134B of the non-SMP rigid containment members 116A and 116B, respectively, in a direction parallel to axis A at which the deformable active material member 112A bends (see FIGS. 5 and 6B), but which is retained by the non-SMP edge features 134A and 134B if loaded in a direction perpendicular to the bend axis A. The features 130A-130B and 134A-134B are not shown in FIGS. 3-5 for purposes of clarity in the drawings. FIGS. 6A and 6B illustrate complementary edge features 130A, 130B applied to both sides of the linear SMP deformable active material member 112A, but it will be appreciated that any of the above-described attachment and retention means may be employed, singly or in combination, without departing from the scope of the invention.

Figure 4:
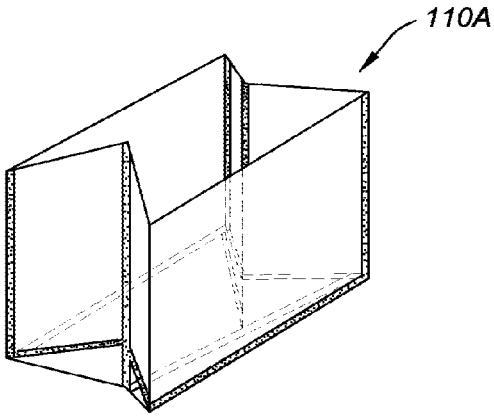
FIG. 4 is a schematic perspective illustration of the shipping container of FIG. 3 in an intermediate configuration during collapse, with the cover flaps of FIG. 3 not shown for clarity.
Figure 7:
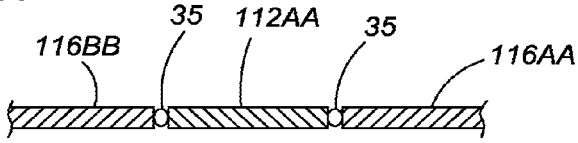
FIG. 7 is a schematic cross-sectional illustration of an alternative connection scheme for the containment members and deformable active material members of the container of FIGS. 3-5.

FIG. 7 illustrates an alternative connection scheme for the container of FIGS. 3-5 that uses adhesives rather than complementary edge features to secure the containment members to the deformable active material members. In this embodiment, a deformable active material member 112AA corresponds in location with deformable active material member 112A of FIG. 3 and is connected using an adhesive 35 to adjacent containment members 116AA and 116BB that correspond in location with containment members 116A and 116B in FIG. 3. Other adjacent containment members of the container that have a deformable active material member therebetween may be connected in like fashion.

When the container 110 is in the deployed configuration shown in FIG. 3 and is heated above $T_g$, the SMP deformable active material elements 112 (including 112A) will change to the low modulus compliant state described previously, and have a first shape as shown in FIG. 3 (first shape of member 112A shown in FIG. 6). When in this state, applying a primary force along directions defined by arrows F1 and a minor biasing force F2 perpendicular to the plane of the lower closure formed by deformable active material components 116A-116F, the container 110 will initially exhibit a partial collapse to the configuration 110A of FIG. 4 and, under continued application of the forces F1, F2, to the collapsed configuration 110B shown in FIG. 5. If maintained in this collapsed configuration 110B until the entire container is cooled below $T_g$, the collapsed configuration 110B will be maintained even in the absence of applied forces F1, F2. However, if the temperature of the collapsed container 110B is increased above $T_g$, the container will return to its deployed configuration 110 through the action of the residual stresses in the deformed active material members 112 induced by the collapse deformation which will relax to zero by operating the deforming active material components 112 and returning them to their stress-free initial condition as exhibited by their shape in FIG. 3. For example, the deformed active material member 112A of FIG. 7 will return to its shape of FIG. 6, causing the containment members 116A and 116B to return to a generally co-planar configuration shown in FIGS. 3 and 6.

Figure 8:
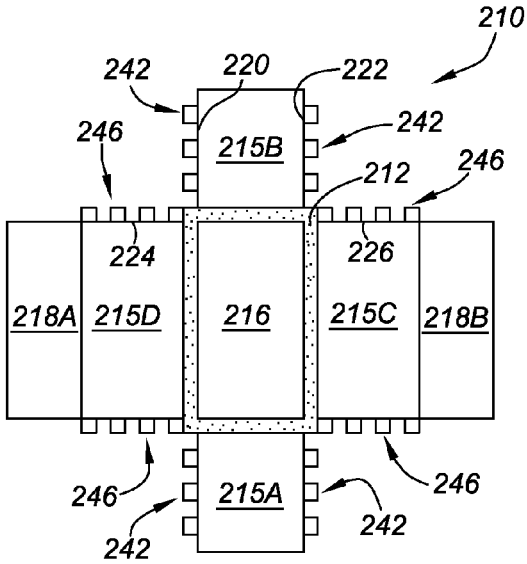
FIG. 8 is a schematic illustration in plan view of a third embodiment of a reconfigurable shipping container in a collapsed configuration.
Figure 9:
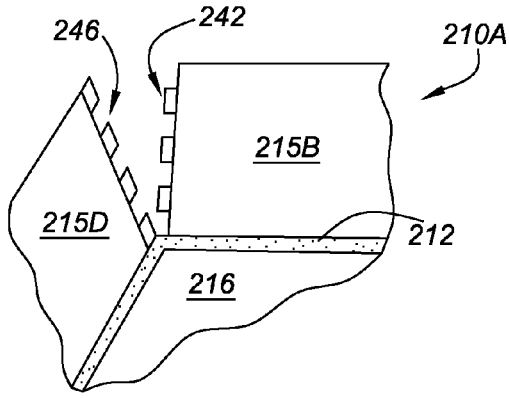
FIG. 9 is a schematic perspective fragmentary illustration of a portion of the container of FIG. 8 in an intermediate configuration transitioning between the collapsed configuration of FIG. 8 and a deployed configuration.

A third embodiment of a container 210 is shown in FIGS. 8 and 9. In FIG. 8, the container 210 is in a fully collapsed configuration and in FIG. 9 the container is shown in fragmentary view in an intermediate configuration 210A transitioning to a deployed configuration (not shown, but which will resemble the overall shape of the container 110 of FIG. 3). In this embodiment, containment members include: sidewalls 215A, 215B, 215C and 215D; lower closure member or base 216; and upper closure members or cover flaps 218A, 218B, hingeably connected to the upper edges of the opposing sidewalls 215C and 215D, or, not shown, a single closure hingeably attached to the upper edge of only one of the sidewalls 215A-215D.

An SMP deformable active material member 212 surrounds the edges of the base 216 to connect and secure the sidewalls 215A-215D to the base 216. The deformable active material member may be secured to the base 216 and sidewalls 215A-215D through welding, adhesives, mechanical fasteners, and/or mechanical interference such as is shown with respect to container 110 in FIGS. 6 and 7. Each of the side edges of sidewalls 215A-215D is releasably attachable to the side edge of the respective adjacent sidewall 215A-215D via a releasable fastener 240 (shown in entirety in FIGS. 10 and 11) which includes a pair of complementary attachment mechanisms 242, 246 on adjacent edges of adjacent sidewalls. (Alternatively, releasable fastener 240A with complementary attachment mechanisms 242A and 246A, shown in FIGS. 12-15, may be used, as further described below). For example, sidewall 215B has edges 220 and 222 that are releasably attached or abutted to the side edges 224, 226 of adjacent sidewalls 215D and 215C, respectively. The releasable fastener attachment mechanisms 242, 246 must be sufficiently strong to remain attached during use and should also be durable and easy to release. Individual attachment mechanisms may be employed at each pair of adjacent edges, as suggested by the above, or the attachment mechanism could cooperatively involve all edges simultaneously, for example by wrapping a flexible member such as an adhesive backed tape, a rope, an elastic cord or a chain around the periphery of the deployed container and tensioning it, thereby securing all sidewalls 215A-215D in an orthogonal relationship to one another with a single device.

Figure 10:
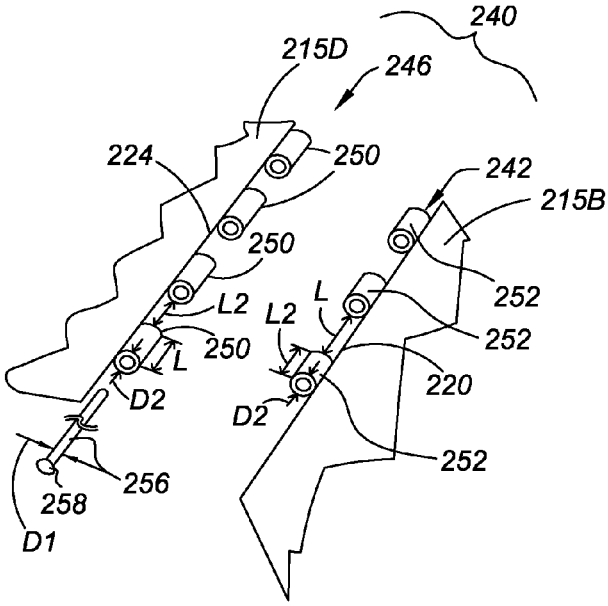
FIG. 10 is a schematic perspective exploded illustration of a releasable fastener including attachment mechanisms secured to adjacent edges of containment members of the container of FIGS. 8 and 9 and a securing member.
Figure 11:
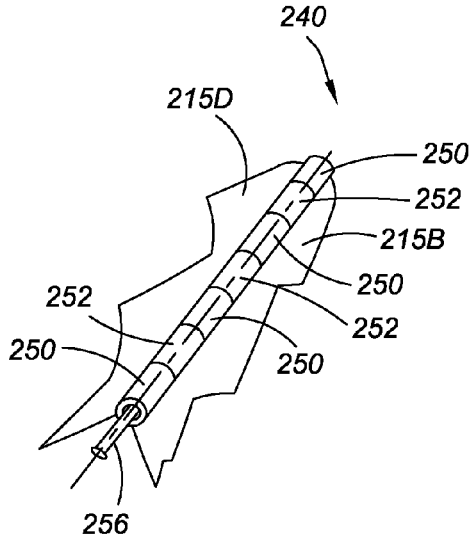
FIG. 11 is a schematic perspective illustration of the releasable fastener of FIG. 10 in a fastened state.
Figure 12:
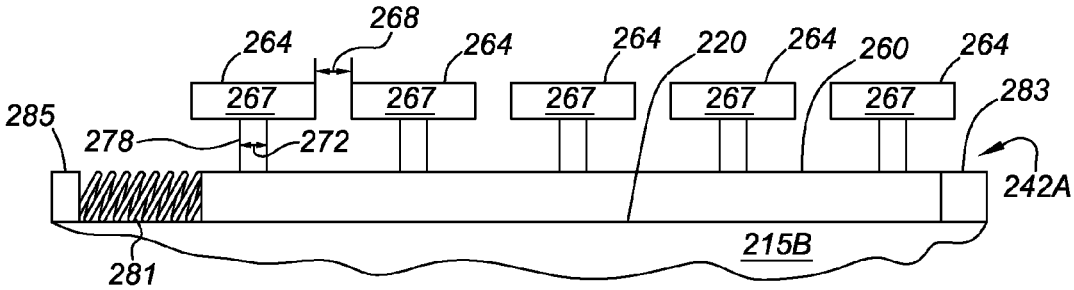
FIG. 12 is a schematic fragmentary plan view illustration of an alternative attachment mechanism installed on an edge of a containment member of the container 210 of FIG. 8.

Releasable fastener 240 is shown in FIGS. 10 and 11. In this embodiment, the releasable fastener 240 includes attachment mechanism 246, which is a plurality of hollow cylindrical elements 250, each of length L1 and spaced a uniform distance L2 apart mounted on edge 224 of sidewall 215D. Attachment mechanism 242 is a similar series of hollow cylindrical elements 252 of like dimension L1 and spacing L2 mounted on edge 220 of sidewall 215B.

The cylindrical elements 250, 252 on the different edges 224, 220 are offset from one another by a gap L2 equal to or greater than the length 250 of the cylindrical elements 250, 252, i.e. L2≧L1, such that when the two edges 220, 224 are brought together, the centers of the cylindrical elements 250, 252 will lie on a common axis. Furthermore, the releasable fastener 240 includes a rod-like member 256 of diameter D1 insertable within the interior diameter D2 of the hollow cylindrical elements 250, 252 when these are aligned as in FIG. 11 to releasably fasten sidewalls 215B and 215D to one another. Rod-like member 256 should have a portion 258 such as a head or section of increased diameter at its end to limit penetration of member 256 in the aligned cylindrical elements 250, 252 to only its entire length. When fully inserted as shown in FIG. 11, the rod-like member 256 will lie approximately along an axis corresponding to the centers of both sets of cylindrical elements 250 and 252 and will thereby generate an interference between the member 256 and each of the sets of cylindrical elements 250, 252 such that they are constrained to remain in the same relative positions until the member 256 is removed, thereby releasably attaching the adjacent sidewalls 215D, 215B. Similar features would be located on all adjacent sidewall edges and a similar procedure would be followed to attach and detach these sidewalls.

Figure 13:
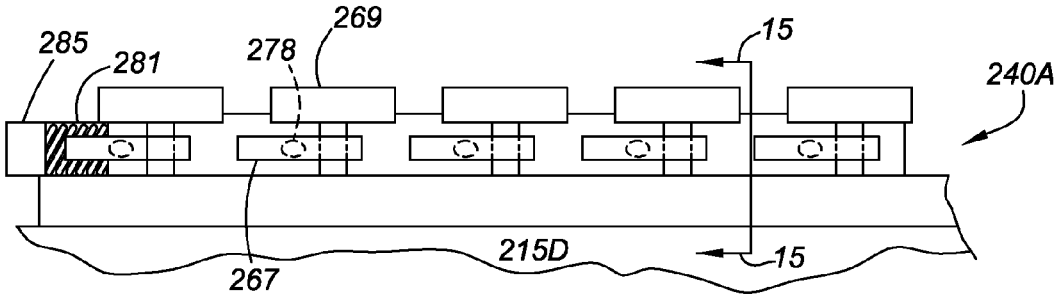
FIG. 13 is a schematic fragmentary plan view illustration of an alternative releasable fastener including the attachment mechanism of FIG. 12 releasably fastened to a second attachment mechanism shown in FIG. 14 and installed on another edge of the container of FIG. 8.
Figure 14:
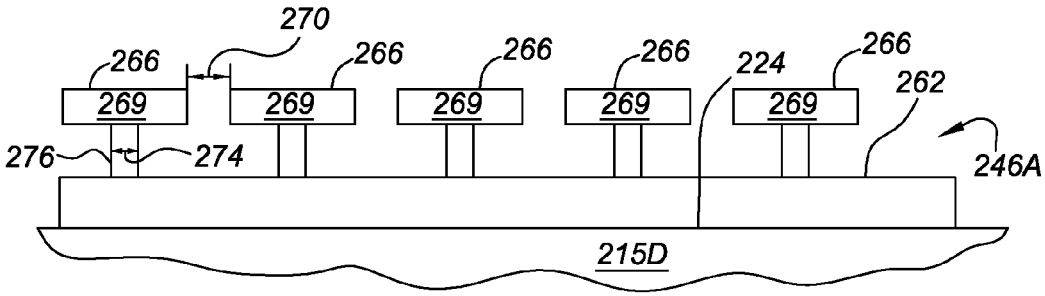
FIG. 14 is a schematic fragmentary plan view illustration of the second attachment mechanism of FIG. 13.
Figure 15:
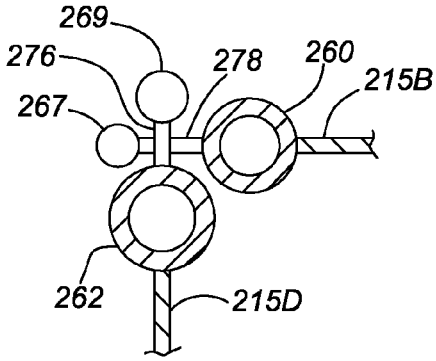
FIG. 15 is a schematic cross-sectional fragmentary illustration in end view of the releasable fastener of FIG. 13.

FIG. 13 shows another example of a releasable fastener 240A that could be used in lieu of fastener 240 to releasably attach adjacent edges 220 and 224 of sidewalls 215B and 215D. The releasable fastener 240A includes two attachment mechanisms referred to as 242A and 246A, which are secured on the edges 220, 224 and would appear in FIGS. 8 and 9 in the same positions as correspondingly numbered attachment mechanisms 242 and 246. Attachment mechanism 242A actively engages the attachment mechanism 246A, which passively accepts the attachment mechanism 242A when engagement occurs, as described below.

Referring to FIGS. 12-15, both attachment mechanisms 242A, 246A include a respective shaft 260, 262, with a plurality of generally regularly spaced features 264, 266, respectively, generally having the form of a letter "T" attached to the respective shafts 260, 262 such that the cross-bar section 267, 269 of the "T" which lies parallel to the shaft 260, 262, is spaced apart from the similar section of its adjacent "T" feature 264, 266 by a gap 268, 270. Gaps 268, 270 are greater than the width or diameter 274, 272, respectively, of a section 276, 278 of the "T" which depends perpendicularly from the respective shaft 262, 260. Shaft 262 is fixed to sidewall 215D, but shaft 260 is mounted in such a manner that it may be displaced laterally and rotated, for example (not shown) by containing its ends within hollow cylinders whose interior dimension is sufficiently greater than the diameter of shaft 262 that it may freely slide and rotate relative to sidewall 215B, but not so great as to allow motion in any other directions to any significant degree. Further, the position of shaft 262 is biased, by means of spring 281 (secured at one end to sidewall 215B and at another end to shaft 260) and a stop 283, to be in a position in which the sections 278 of features 264 are not aligned with gaps 270 created between features 266 attached to shaft 262.

To operate the releasable fastener 240A, with the edges 220, 224 moved adjacent one another as in FIG. 9, the following sequence of operations is required. Starting from the position depicted in FIG. 12, the attachment mechanism 242A is displaced to the left, against the urging of spring 281, toward a second stop 285 until the perpendicular section 278 of the features 264 become aligned with the gaps 270 between the cross-bar sections 269 of the features 266 disposed on shaft 262. Without permitting the shaft 260 to return to the right, the shaft 260 should be rotated counterclockwise in FIG. 12 (forward to the position of FIG. 13), enabling the sections 278 to pass through the gaps 270 with which they are aligned and for the two cross-bar sections 267 and 269 to pass one another as shown in the side view of FIG. 15. The shaft 260 is then translated laterally to the right, either by an externally applied force or by the urging of spring 281 such that the shafts 260, 262 adopt the configuration shown in FIGS. 13 and 15 wherein the vertical sections of one shaft, such as 278, interfere with the cross-bar sections of the second shaft, such as 269, and vice versa such that the two are held in a fixed position relative to one another. Reversing the steps described above enables shafts 260 and 262 to disengage, the fastener 240A thereby being released to allow the sidewalls 215B and 215D to be moved apart, such as when moving from the deployed configuration to the collapsed configuration of FIG. 8.

A process of using the container comprises the following steps and operations. First, the collapsed container is heated to a temperature greater than $T_g$ and hold for sufficient time to ensure that the deformable active material members in their entirety achieve the imposed temperature. Next, through the application of directed force, the deformable active material members are deformed in such a manner that the container assumes its deployed configuration. (This assumes that the relaxed, nonstressed shape (permanent shape) of the container corresponds to its collapsed configuration and the deformed shape (temporary shape) corresponds to the deployed configuration. Within the scope of the invention, the relaxed shape may correspond to the deployed configuration instead, and force would then be applied to deform the active material members so that they assume the collapsed configuration in such an embodiment.) The container is then held in its deployed configuration until the temperature of the deformable active material members is reduced below $T_g$ and the container is thereby locked into its deployed configuration. If appropriate, additional attachment mechanisms or other shape-retaining mechanisms, such as a wire form, may be employed to further support the container in holding the desired configuration until the reduced temperature is reached. At this stage the container may be filled with goods and transported to its destination where the goods will be removed and any additional attachment mechanisms removed or otherwise disabled. Now the container, possibly in conjunction with a cleaning operation if the $T_g$ of the deformable active material members permits, is heated above its $T_g$. When all of the deformable active material members achieve a temperature greater than $T_g$ they will return to their original relaxed shape and return the container to its collapsed configuration. Next the temperature is reduced to below $T_g$ while the container is in its collapsed configuration, 'freezing' the collapsed configuration so that the container will continue to maintain itself in the collapsed configuration even if subjected to external loads.

As discussed above, the relaxed shape of the deformable active material members, i.e., the shape they will adopt when under no external load and at a temperature greater than $T_g$, may correspond to the deployed configuration (i.e., the configuration in which the container defines a storage space) of the container, or could equally well correspond to the collapsed configuration of the container without departing from the scope of the invention. In the latter case, the deforming force would be applied to the container in the collapsed configuration when above the predetermined temperature to form the deployed configuration. The container may need to be placed around a form, such as a wire cage, to ensure that the deployed configuration is maintained during the time that the container is being cooled below the predetermined temperature. When the container is then reheated, the internal stresses within the deformable active material members will cause the container to return to its stress-free, collapsed configuration.

Figure 16:
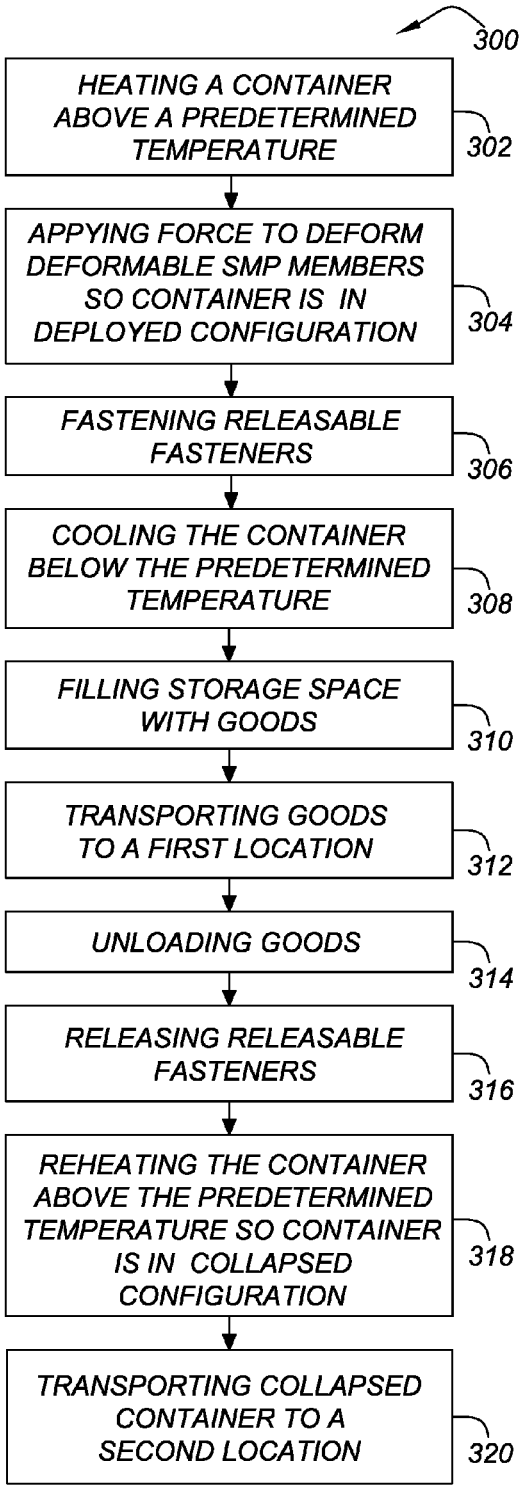
FIG. 16 is a flow diagram illustrating a method of use of a reconfigurable container.

The method of using the reconfigurable containers described herein is set forth as method 300 in the flowchart of FIG. 16. The method requires step 302, heating the container above a predetermined temperature. In the embodiments described above, the deformable active material members are shape memory polymers, and the predetermined temperature is the glass transition temperature $T_g$ of the SMP material of which the deformable active material members are formed. Next, under step 304, a force is applied in at least one direction to deform the deformable SMP members so that the container is in a deployed configuration. In the deployed configuration, the container defines a storage space. The containers 10 and 110 of FIGS. 1 and 3 illustrate deployed configurations. In those embodiments, a force is applied to reconfigure the container from the deployed configuration to the collapsed configurations 10A and 110B shown in FIGS. 2 and 5, respectively. In the method 300, under step 304, the deforming force(s) would instead be applied to the collapsed configurations 10A and 110B of FIGS. 2 and 5 to reconfigure the containers to the deployed configurations of FIGS. 1 and 3, and would be opposite in direction to the force(s) illustrated in FIGS. 1 and 3.

When the container is in the deployed configuration, optionally, the method 300 may require step 306, fastening releasable fasteners to further secure the containment members of the container in their positions required in the deployed configuration. The container 110 of FIGS. 8-11 requires such fasteners 240.

When the container is in its deployed configuration and any required releasable fasteners are fastened, the method 300 requires step 308, cooling the container below the predetermined temperature, so that the container retains its deformed, deployed configuration indefinitely as long as the temperature of the deformable active material members are kept below the predetermined temperature.

Once the container is below the predetermined temperature, the method follows step 310, filling the storage space of the container with goods, step 312, transporting the goods to a first location, and step 314, unloading the goods. Step 312 is optional, as the containers could be used for storing the goods at one location, with both the filling and unloading steps 310 and 314 occurring at that location.

After the goods are unloaded in step 314, assuming there is no immediate need to fill the containers with any other goods, the method moves to step 316, releasing any releasable fasteners that may have been fastened earlier. The container is then ready for step 318, reheating above the predetermined temperature so that internal stresses within the deformable active material members caused by the deformation are relieved, with the container recovering its original collapsed configuration. When in the more compact collapsed configuration, step 320, transporting the collapsed container to a second location, can be accomplished with less volume occupied on the transport vehicle by the empty, collapsed container than would be required were it still in its deployed configuration. Within the scope of the invention, the goods may be partially unloaded at the first location, then transported to one or more additional locations where they are further unloaded before steps 316, 318 and 320 are carried out.

Figure 17:
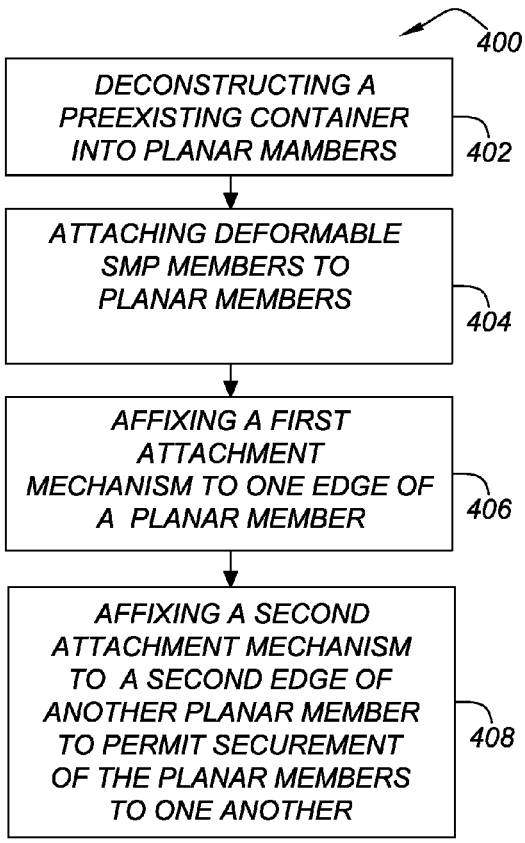
FIG. 17 is a flow diagram illustrating a method of fabricating a reconfigurable container.

Existing shipping containers that do not offer the convenient reconfigurability afforded by a shipping container with deformable active material members may be modified according to the method of fabricating a reconfigurable container from a preexisting container 400 illustrated in the flowchart of FIG. 17. Specifically, a preexisting container may be deconstructed into generally planar members under step 402. For example, assuming that the planar members 215A-D, 216 and 218A-B are attached directly to one another in the layout of FIG. 8 with no deformable active material members 212 or releasable fasteners on any of the edges, they could be deconstructed into five separate pieces: base 216, sidewall 215B, sidewall 215A, sidewall 215D with cover member 218A thereon, and sidewall 215C with cover member 218B thereon. Then, under step 402, deformable active material members are attached to the planar members. For example, referring to FIG. 8, deformable active material members 212 are attached to the four edges of base 216 and to adjacent sidewalls 215A-215D to connect the sidewalls 215A-D to the base 216.

After the containment members are interconnected via deformable active material members, the method may include step 406, in which a first attachment mechanism is affixed to one edge of a planar member and step 408, in which a second attachment mechanism is affixed to a second edge of another one of the containment members to permit securement of those edges of the containment members to one another. The attachment mechanisms form a releasable fastener and may be fastened to one another to secure the edges together. For example, in FIG. 8, attachment mechanisms 242 and 246 are affixed to the edges 220 and 224 and can be fastened as illustrated in FIG. 11. Alternatively, other types of attachment mechanisms, such as 242A and 246A of FIGS. 12-15 may be used. Once the deformable active material members and any required attachment mechanisms are installed on the containment members per steps 402-408, the container is now a reconfigurable container that may be used according to the method 300 of FIG. 16 to hold goods in a deployed configuration and collapse to a more compact, space-saving configuration when not being used to hold goods.

While the best modes for carrying out the invention have been described in detail, those familiar with the art to which this invention relates will recognize various alternative designs and embodiments for practicing the invention within the scope of the appended claims.

The invention claimed is:

1. A reconfigurable container comprising:

at least one deformable active material member;

wherein the at least one deformable active material member is at least one heat-activatable, shape memory polymer material having a glass transition temperature above which a decrease in modulus of elasticity occurs;

wherein the at least one deformable active material member is configured to deform to adopt a first configuration and a second configuration and is reconfigurable between one of the first configuration and the second configuration to the other of the first configuration and the second configuration;

wherein the at least one deformable active material member is configured to deform from the first configuration to the second configuration upon the application of a temperature greater than the glass transition temperature in combination with the application of an external load thereto;

wherein the at least one deformable active material member is configured to automatically return to the first configuration from the second configuration upon the application of the temperature greater than the glass transition temperature in combination with the removal of the application of the external load;

wherein the at least one deformable active material member is configured to remain deformed in the second configuration when the applied temperature is reduced below the glass transition temperature before the external load is removed;

wherein one of the first and second configurations defines a storage space and the other of the first and second configurations is more compact than the configuration defining the storage space; and wherein the at least one deformable active material member includes multiple deformable active material members arranged in approximately orthogonal relationship to one another when the container has the first configuration.

2. The container of claim 1, wherein the glass transition temperature is less than 100 degrees Celsius.

3. The container of claim 1, wherein the glass transition temperature is not less than 50 degrees Celsius and not greater than 80 degrees Celsius.

4. The container of claim 1, wherein the at least one deformable active material member includes multiple deformable active material members, and further comprising:

a plurality of generally rigid containment members; wherein the deformable active material members interconnect at least some of the containment members.

5. The container of claim 4, wherein the generally rigid containment members are fabricated of at least one of cardboard, polymer, metal and any combination thereof.

6. The container of claim 4, wherein the generally rigid containment members are secured to the deformable active material members.

7. The container of claim 4, wherein the generally rigid containment members are elongated strips spaced from one another with said at least one deformable active material member therebetween.

8. The container of claim 4, further comprising:

releasable fasteners; wherein at least some of the containment members are secured to one another via the releasable fasteners.

9. The container of claim 4, wherein the generally rigid containment members are generally planar.

10. The container of claim 9, wherein at least some of the deformable active material members include a first geometric feature and at least some of the containment members include a second geometric feature; and wherein the deformable active material members having the first geometric feature are secured to the containment members having the second geometric feature through mechanical interference of the first and second geometric features.

* * * * *